US008465027B2

(12) United States Patent
Burke

(10) Patent No.: US 8,465,027 B2
(45) Date of Patent: Jun. 18, 2013

(54) ROLLER SKATE STEERING AND SUSPENSION MECHANISM

(76) Inventor: Jacob Burke, Groveland, MA (US)

( * ) Notice: Subject to any disclaimer, the term of this patent is extended or adjusted under 35 U.S.C. 154(b) by 81 days.

(21) Appl. No.: 13/134,775

(22) Filed: Jun. 16, 2011

(65) Prior Publication Data

US 2011/0316245 A1 Dec. 29, 2011

Related U.S. Application Data

(60) Provisional application No. 61/398,371, filed on Jun. 24, 2010.

(51) Int. Cl.
*A63C 17/02* (2006.01)

(52) U.S. Cl.
USPC ..... 280/11.27; 280/11.19; 280/87.1; 280/841; 280/87.041; 280/87.042; 280/11.25; 280/11.28; 280/87.01; 280/87.021; 280/87.03

(58) Field of Classification Search
USPC ..... 280/11.27, 87.1, 841, 11.25, 87.03
See application file for complete search history.

(56) References Cited

U.S. PATENT DOCUMENTS

| | | | | |
|---|---|---|---|---|
| 2,356,736 | A | 8/1944 | Blaes | |
| 2,510,722 | A | 6/1950 | Snyder | |
| 4,345,774 | A | 8/1982 | Poe et al. | |
| 4,596,396 | A * | 6/1986 | Merbler | 280/11.28 |
| 6,182,987 | B1 * | 2/2001 | Bryant | 280/87.042 |
| 6,474,666 | B1 * | 11/2002 | Andersen et al. | 280/87.041 |
| 6,547,262 | B1 | 4/2003 | Yamada et al. | |
| 7,287,762 | B2 * | 10/2007 | Stratton | 280/11.27 |
| 7,303,196 | B2 * | 12/2007 | Harper | 280/11.28 |

* cited by examiner

*Primary Examiner* — J. Allen Shriver, II
*Assistant Examiner* — Hilary L Johns
(74) *Attorney, Agent, or Firm* — Scott Lefton

(57) ABSTRACT

A triple action roller skate steering and suspension mechanism includes upper and lower cushions clamped on either side of a skate truck, plus a third action comprising a floating cushion mechanism supporting and surrounding the pivot cup portion of a pivot joint mechanism. A pivot pin is threaded into the skate truck and can be preloaded against the pivot cup and floating cushion mechanism, thereby providing improved shock absorbing, durability and adjustability. The roller skate base plate is a unitary structure including a hollow arch for lightweight structural reinforcement.

36 Claims, 9 Drawing Sheets

ROLLER SKATE STEERING AND SUSPENSION MECHANISM

This patent application claims the benefit of the priority date of Provisional Patent Application No. 61/398,371 filed Jun. 24, 2010 entitled ROLLER SKATE STEERING AND SUSPENSION MECHANISM.

BACKGROUND OF THE INVENTION

1. Field of the Invention

The present invention relates generally to a roller skate steering and suspension mechanism, and more particularly to a triple action steering and suspension mechanism providing more responsive and durable operation during competitive roller skating.

2. Description of the Prior Art

Roller skate steering and suspension mechanisms have been in production for over a century. The modern quad roller skate, with a forward pair of wheels and a rear pair of wheels, generally has each pair of wheels secured to an axle which is mounted in a truck that is pivotally connected to a skate base plate, which is in turn secured to the skate boot or shoe. The trucks provide steering response whereby when a skater shifts weight laterally across the base plate, the truck twists, causing the axle to turn. The forward and rear trucks are mounted oppositely so that the axles will turn in opposite directions, causing the wheels to travel in an arc. The trucks also serve, by means of a resilient suspension system, to resist the skater's lateral tilt of the base plate, thus stabilizing the base plate and returning it to a centered and horizontal position when the turn is completed. Skate trucks generally sacrifice the ability to turn in exchange for lateral stability, thus becoming stiff and unresponsive when tightened sufficiently. Conversely, loosening the trucks for improved turning can lead to mechanical instability. Stiffer skate mechanisms will more efficiently transfer muscle power to skate speed, and are preferred by speed skaters who aren't likely to be making many sudden turns. Additional factors affecting roller skate performance include base plate weight, stiffness and durability, where the ideal roller skate base plate balances the tradeoffs of light weight, high stiffness and sufficient durability.

The steering and the resilient suspension system are generally implemented including a single or a double action mechanism. The single action mechanism has one cushion, usually made of rubber or a urethane compound, that sits on the side of the truck facing towards the base plate. This is referred to as the load bushing or inner cushion. The double action mechanism has two cushions, one above and one below the truck, relative to the base plate. This second cushion is referred to as the steering bushing or outer cushion. The single action mechanism is older and generally is not used for skating styles requiring fine control. Most modern skating mechanisms are of the double action variety. Skateboards generally use steering and suspension mechanisms very similar to those used by roller skates, and have similar shock absorbing, steering and lateral stability requirements.

The truck typically also includes a cushion mount and a tubular stem which in higher quality roller skates is threaded to hold an adjustable pivot. The cushion mount typically has a ring-shaped area with recesses on both axial faces to position a pair of tubular cushions formed from urethane or other elastomeric material. A stud or kingpin is typically fastened into the base plate and is inserted through the ring-shaped area and through axial openings in the cushions and in many higher quality roller skates is secured with a nut along a threaded length protruding outward from beyond the cushions. In some cases a portion of the threaded length is split and the nut may have compression calibration marks for setting cushion compression as part of the skate suspension and steering adjustment. This kind of nut is called a micrometer nut and is typically locked in place with a taper-headed set screw. A ball ended stud (or ball stud) functions as a rounded pivot and is typically threaded into the tubular stem of the truck and the ball end of the stud is seated in a pivot cup, which in the prior art is typically made of rubber, elastomer, brass, steel, or a polymer such as Delrin. Frequently in high performance quad skates the ball stud can be threaded inward or outward from the truck to adjust the action of the skate steering and suspension. Prior art adjustable pivots allow skaters to set the angle of the trucks and also set the degree of preload on both the load bushing and the steering bushing. Washers and other fasteners may be used to adjust the elastic performance of the cushions. Typically the two pair of wheels and their support hardware are identical for front and back.

The truck geometry also influences skate steering and lateral stability, where major factors include the orientation of the pivot pin, the axle and the kingpin, and the angular relationship between these parts. If the axle is positioned between the pivot pin and the kingpin, the skate will have better lateral stability but less responsive steering. If the pivot pin and the kingpin are adjacently positioned and the axle is positioned out beyond the kingpin, the steering will be more responsive but the lateral stability will decrease. This geometry also tends to shorten the wheelbase, thus further decreasing overall stability. It has been found that having an approximately 45 degree angle between the pivot pin and the base plate, and also an approximately 45 degree angle between the kingpin and the base plate, yields a very responsive steering geometry, though with a consequent decrease in lateral stability. Depending on the skating style, this may be preferred.

For competitive roller skating activities such as roller derby, the skate mechanism is subjected to extreme impacts during jumps and falls, as well as the stresses of high speed skating, tight turns and the dynamic forces caused by sudden acceleration and deceleration. One particular problem with prior art skate mechanisms is wear and damage to the pivotal connection between the truck and the base plate. The simplest pivotal connection is generally a protruding portion of the truck with a rounded end, engaging a rounded recess in the base plate. As the resiliently mounted truck moves, the pivotal connection will rotate through some amount of arc, but it may also momentarily separate and then re-contact with some amount of impact, an effect known as "slap". This will wear the joint and over time the amount of separation and slap will increase. The skate mechanism will also feel looser and less tightly controlled, and may eventually fail due to stress and impact. Additionally, slap and mechanism play will cause fatigue to the skater and may even promote joint injuries. Mechanism play can also increase the probability of sudden component failure. The impacts experienced by the skate mechanisms can cause the cushions to suffer heavy uneven wear, the pivot cups to wear and even crack, and the kingpins to crack as well. Sudden component failure can easily lead to skater injuries. Also, increasing steering responsiveness by overly loosening the resilient clamping around the trucks can lead to sudden pivot joint separation and consequent spinning of the truck around the kingpin, with skater injury being a likely result.

Prior art improvements on this pivotal connection have generally taken one of two forms. A cup formed of resilient material is inset into the base plate to receive the pivot, thus providing some degree of shock absorbing. This cup will wear over time and under extreme circumstances (which are not infrequently encountered in activities such as roller derby) may actually crack apart. Alternatively, a metal insert formed of a relatively slippery alloy such as bearing bronze and having a spherical section recess may be inset into the base plate, and a pivot having a ball end engages it. The pivot action may be further improved by threading into the truck and being pre-loaded against the metal insert. This style of pivotal connection will provide no shock absorbing but will pivot smoothly for a while. Eventually it will wear and then slap will increase.

The tradeoff between skate lateral stability and steering performance has been a source of many skate inventions too. U.S. Pat. No. 7,287,762 entitled TRUCK FOR SKATEBOARDS teaches a truck mechanism with a pin-kingpin-axle configuration in order to permit tighter turns, and incorporating the standard paired elastomeric cushions and a resilient cup to cushion the pivot pin. The '762 patent also teaches having the kingpin perpendicular to the pivot pin with the axis of each at approximately 45 degrees to the base plate, which tends to provide a highly responsive steering geometry. Also taught are a variety of angular orientations for the kingpin and pivot pin, thus affording a variety of performance styles to a skateboard.

However, the '762 patent does not teach any means for preloading the pivot mechanism for protection against static and dynamic forces, and the resilient cup provides a very limited amount of shock absorbing and historically has been prone to high wear and even splitting apart.

U.S. Pat. No. 6,547,262 entitled SKATEBOARD TRUCK ASSEMBLY teaches the use of different geometries of load and steering bushings, including a necked-down bushing for increased ease in steering. Also taught is a pivot pin mechanism comprising a pivot pin having a cylindrical section engaging a ball bearing seated in an elastomeric cup. This mechanism provides free rotary pivoting and some shock absorption for the ball bearing and pivot pin.

However, the pivot pin taught by the '262 patent primarily offers free rotation around a single axis rather than in all directions as a ball joint provides, and suffers the well known problems of the limited shock absorbing response and limited durability provided by a resilient cup. Nor is the pivot pin adjustable for preloading. Additionally, the pin-axle-kingpin geometry will provide less tight turning capability than a pin-kingpin-axle geometry.

U.S. Pat. No. 6,182,987 entitled TRUCK ASSEMBLY WITH REPLACEABLE AXLES AND BALL JOINT PIVOTS teaches the use of different geometries of upper and lower elastomeric cushions, including a hemispherical cushion engaging a socket in the truck for improved rotation and steering. An adjustable pivot pin with a ball end engaging a spherical section shock-absorbent socket is also taught.

However, the '987 patent also suffers from the problems of the limited shock absorbing response and limited durability provided by a resilient cup, even though the ball joint will provide an improvement in rotation. In addition, the pin-axle-kingpin geometry will provide less tight turning capability than a pin-kingpin-axle geometry.

A more capable and robust roller skate steering and suspension mechanism would provide a pre-loadable, adjustable, durable yet resilient pivoting connection between the skate truck and the base plate, effectively creating a third action to augment the double action skate mechanism. Additionally, the base plate portion of the mechanism would be extremely lightweight and stiff to reduce skater fatigue and increase performance, and very durable to avoid breakage during competitive skating activities. Such a skate mechanism would be usable in skateboards as well.

SUMMARY

A more responsive and durable roller skate steering and suspension mechanism comprises a base plate having at least one pivot cup mounting hole and at least one kingpin mounting hole, a pivot cup with a cup socket and a cup body and a cup end, wherein the pivot cup is disposed in the pivot cup mounting hole such that the cup socket faces outwards, a kingpin having an axis and being mechanically fastened into the kingpin hole, a skate truck having a wheel axle holder and a pivot pin socket and a kingpin aperture wherein a portion of the kingpin is radially surrounded by the kingpin aperture, a pivot pin having a rounded pivot end and a threaded end and an axis, wherein the threaded end is threaded into the pivot pin socket and the rounded pivot end rotationally engages the cup socket, the pivot cup mounting hole having interior sides and a bottom, a radially disposed resilient means for shock absorbing in mechanical communication between a portion of the cup body and a portion of the pivot cup mounting hole interior sides, an axially disposed resilient means for shock absorbing in mechanical communication between a portion of the cup end and a portion of the pivot cup mounting hole bottom, the pivot pin axis and the kingpin axis being intersecting, an upper resilient cushion disposed above the skate truck and a lower resilient cushion disposed below the skate truck, and, the upper resilient cushion and the lower resilient cushion being clamped against the skate truck along the kingpin axis.

According to another aspect of the present invention, the pivot pin is axially adjustable to regulate force of contact between the pivot and the pivot cup, thereby providing mechanical preloading for the roller skate steering and suspension mechanism against both static and dynamic loads.

According to yet another aspect of the present invention, the base plate is made of a single piece of material and includes a transversely open reinforcing arch to provide lightweight lengthwise stiffening, wherein the transverse opening through the arch is an oval and the area underneath the arch is open through the body of the base plate, thus providing further lightening of the base plate with a minimum of decrease in structural strength.

Objects and Features of the Invention

It is an object of the present invention to provide a roller skate steering and suspension mechanism with a triple action to improve the performance and robustness of both steering and suspension under both static and dynamic loads.

It is another object of the present invention to provide a lighter, stiffer and more durable base plate as part of the roller skate steering and suspension mechanism.

It is a feature of the present invention to provide a third action comprising a floating pivot assembly having both radial and axial resilient means for support.

It is another feature of the present invention to have a floating pivot assembly having means for preloading.

It is yet another feature of the present invention to have a base plate formed of a single piece of material and having a transversely open reinforcing arch.

It is still another feature of the present invention for the transverse opening through the arch to be approximately an oval and the area underneath the arch to be open through the body of the base plate.

BRIEF DESCRIPTION OF THE DRAWINGS

The present version of the invention will be more fully understood with reference to the following Detailed Description in conjunction with the drawings of which.

DESCRIPTION OF THE PREFERRED EMBODIMENTS

Figure 1:
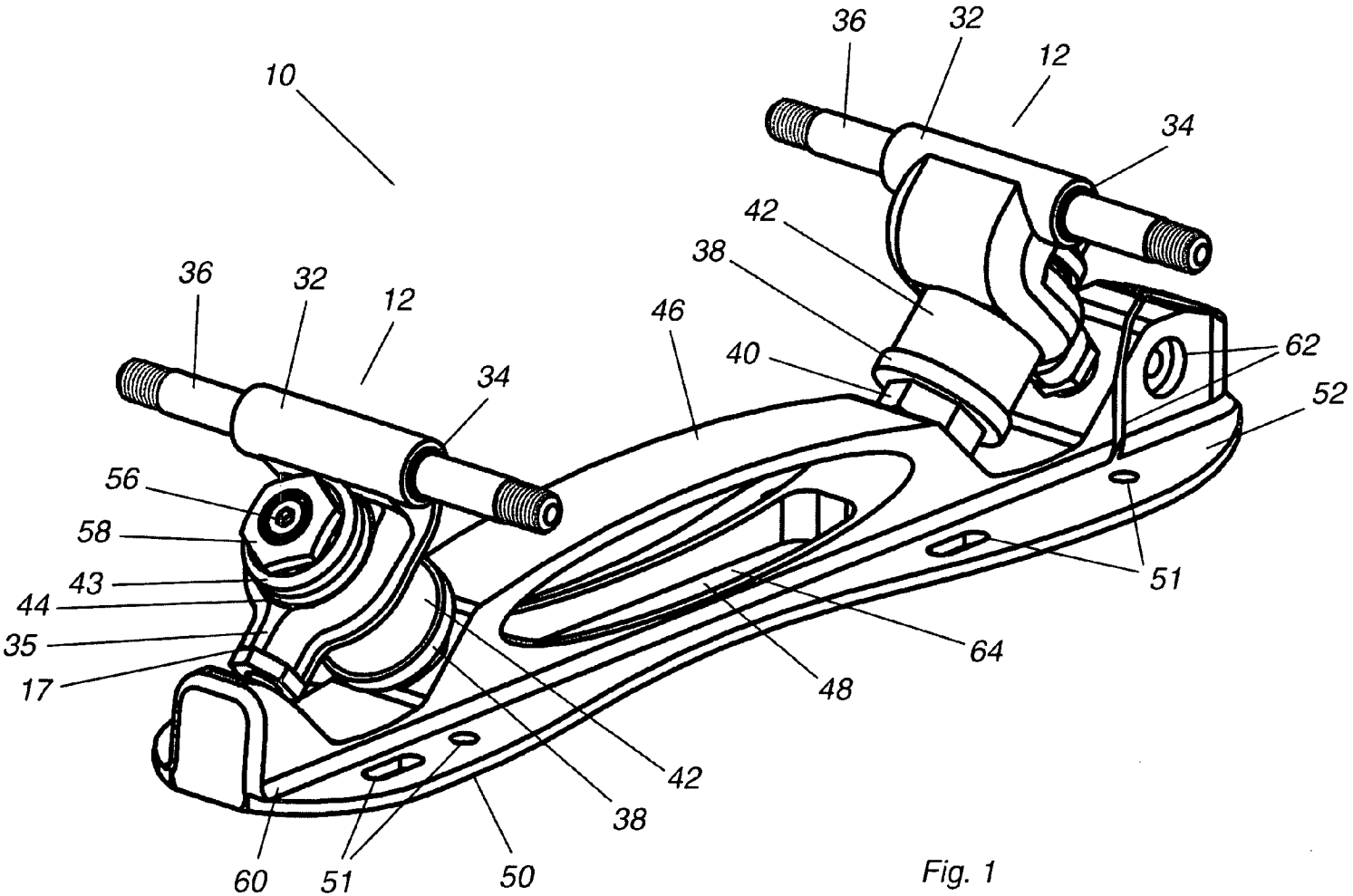
FIG. 1 is a perspective view of a first roller skate steering and suspension mechanism.

FIG. 1 shows a first version of the roller skate steering and suspension mechanism 10. A skate truck assembly 12 is mounted at each end of the base plate 50 by means of a kingpin 40 upon which are sequentially placed an inner cushion support 38, an inner cushion 42, a skate truck 32, an outer cushion 44, an outer cap 43, a micrometer nut 58 and a kingpin set screw 56. The inner cushion 42 and outer cushion 44 are clamped against the skate truck 32 and the micrometer nut 58 is used to set the degree of clamping pressure with fine control. The micrometer nut 58 is locked in place by the kingpin set screw 56. This portion of the mechanism provides a means for double action steering and suspension and is shown both as an assembly and in an exploded form in FIG. 3. Preferably the inner cushion 42 and the outer cushion 44 are made of a elastomeric materials such as urethane. Identical or different resilient materials can be used to additionally tune the steering and suspension response. The kingpin 40 of the present invention has radiused shoulders to further distribute shearing load, wherein a radius of 1 mm or greater is preferred.

Figure 2:
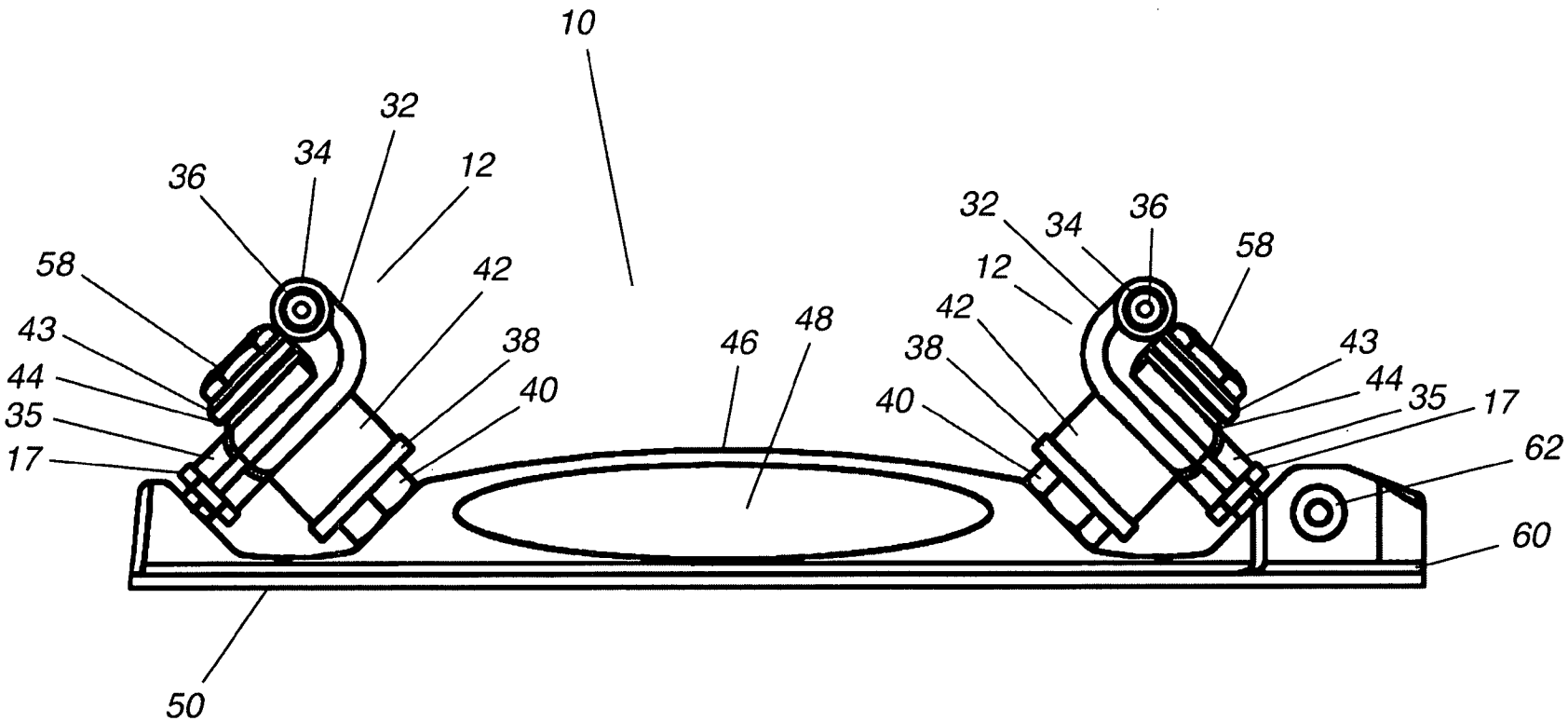
FIG. 2 is an elevation view of a first roller skate steering and suspension mechanism.
Figure 3:
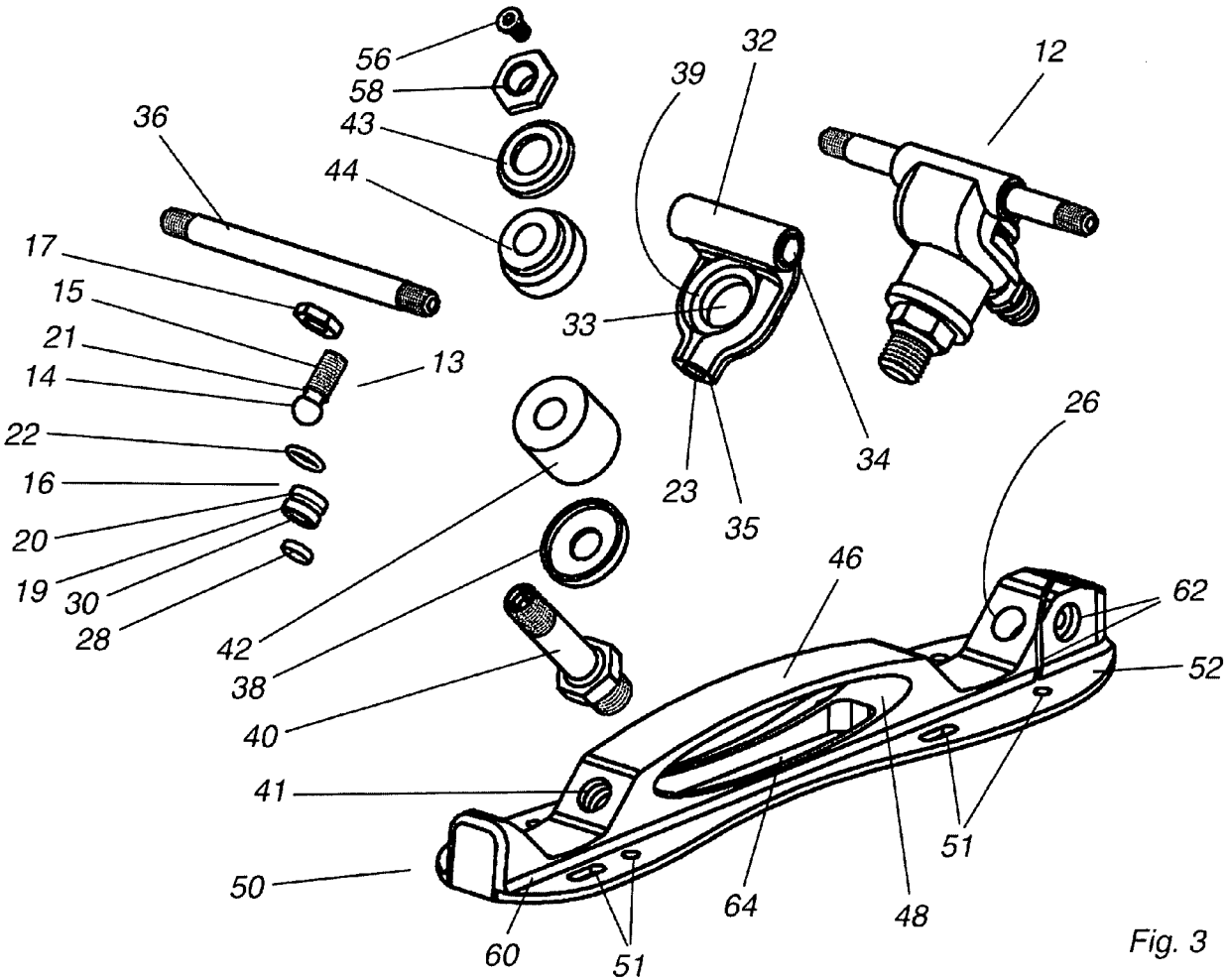
FIG. 3 is a partially exploded view of a first roller skate steering and suspension mechanism.
Figure 7A:
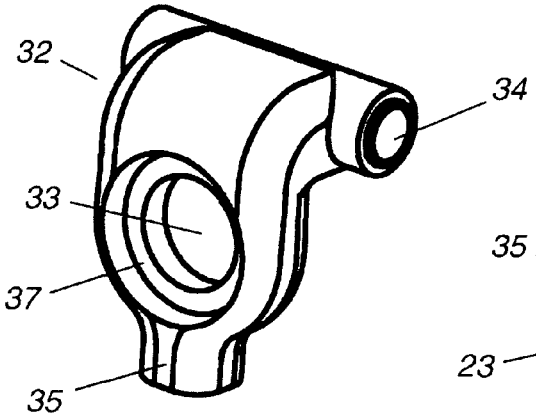
FIG. 7*a* is a first perspective view of a first truck.
Figure 7B:
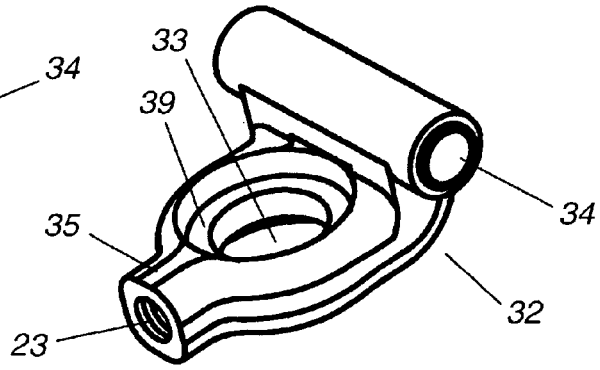
FIG. 7*b* is a second perspective view of a first truck.

FIG. 2 shows the profile of the roller skate steering and suspension mechanism, wherein the profile shape of the skate truck 32 can be more clearly seen. The axle 36 is placed out beyond the kingpin 40, thereby increasing the steering responsiveness of the skate mechanism. By curving the tubular axle holder 34 portion of the skate truck 32 up from the main body plane, the axles 36 and the skate wheels (not shown) are thereby further apart and the wheelbase is lengthened to improve lateral stability of the roller skate. FIGS. 3, 7*a* and 7*b* show the truck in greater detail, including the inner cushion recess 37 for holding the inner cushion 42, the outer cushion recess 39 for holding the outer cushion 44, and the kingpin aperture 33 through which the kingpin 40 is placed. The tapered top of the outer cushion 44 is a prior art feature.

Figure 9:
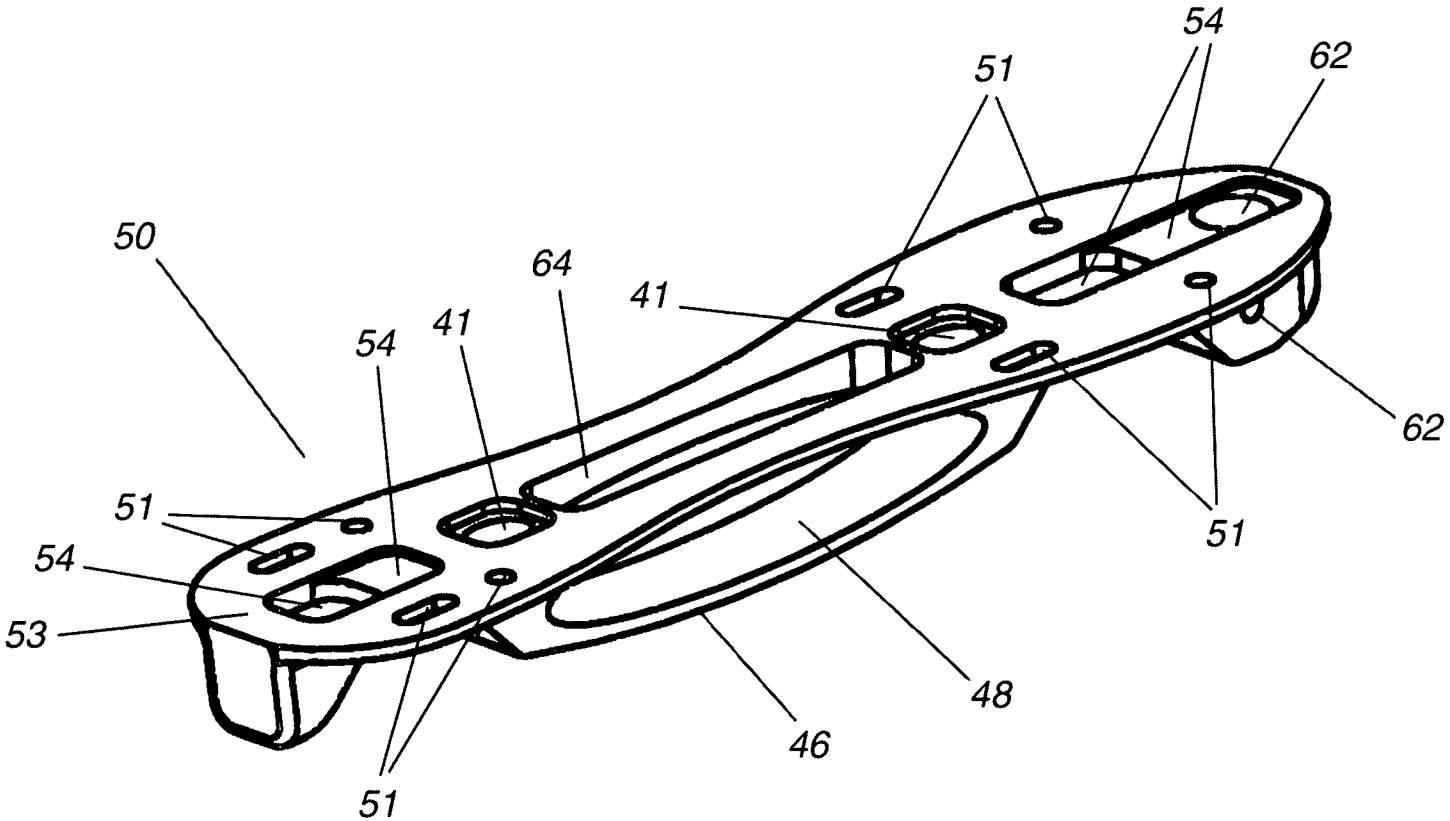
FIG. 9 is a base plate underside perspective view.

The base plate 50 has an integral arched stiffener bar 46 with oval side openings 48, effectively forming a double arch for structural strength and light weight, thus adding torsional and bending rigidity to the base plate 50 and reducing weight without adding the safety hazards associated with a vertically oriented stiffening rib, or the weight penalty of a heavier prior art stiffener such a box beam, or a separate bent stiffening rib. The kingpins 40 are threaded into the kingpin recesses 41 but the weight reduction in the base plate 50 design does not decrease the ability of the kingpin 40 to transfer loads to the base plate 50. The outside shape of the base plate 50 is configured to follow more closely the shape of a skate boot bottom, thus providing more complete and uniform support of the boot. Mounting holes 51 are used in combination with appropriate fasteners to secure the base plate 50 to a skate shoe or boot. The top surface of the plate 52 has a fillet 60 along both sides to prevent stress cracking under impact. This fillet extends past the bumper clamping features 62. FIG. 9 shows the bottom surface 53 of the base plate 50, including the weight reduction pockets 54 and the bottom opening 64 which provides additional weight savings under the arched stiffener bar 46.

Figure 6A:
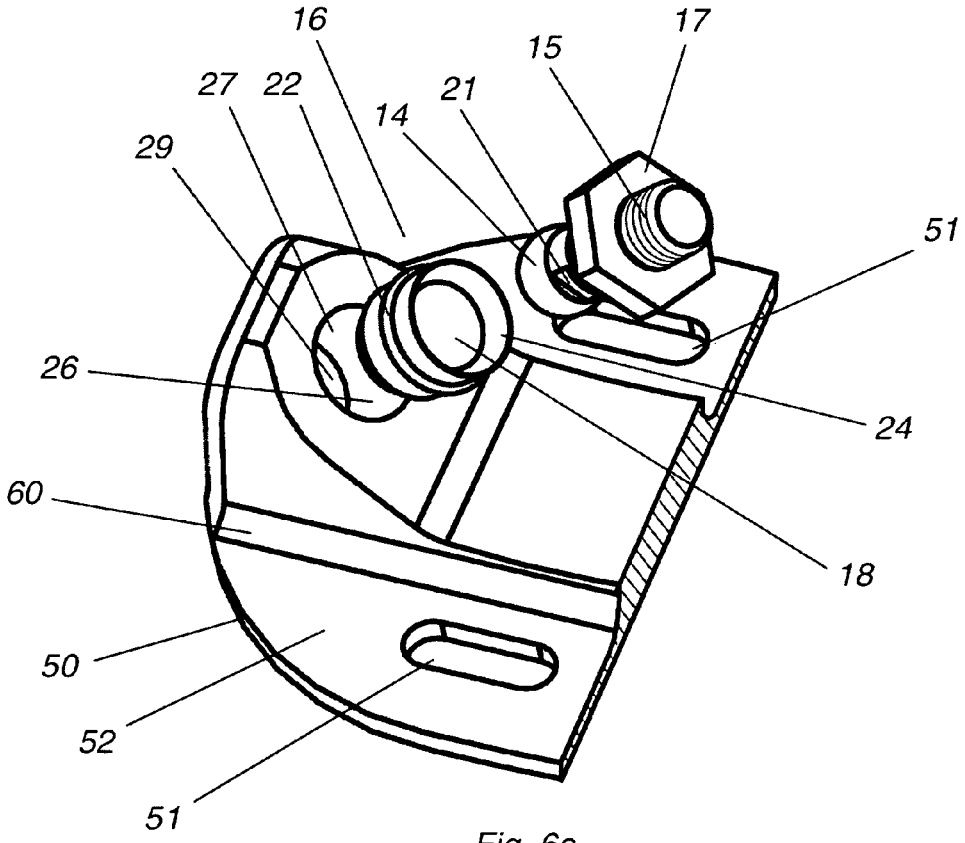
FIG. 6*a* is a first view of a pivot and pivot cup assembly.
Figure 6B:
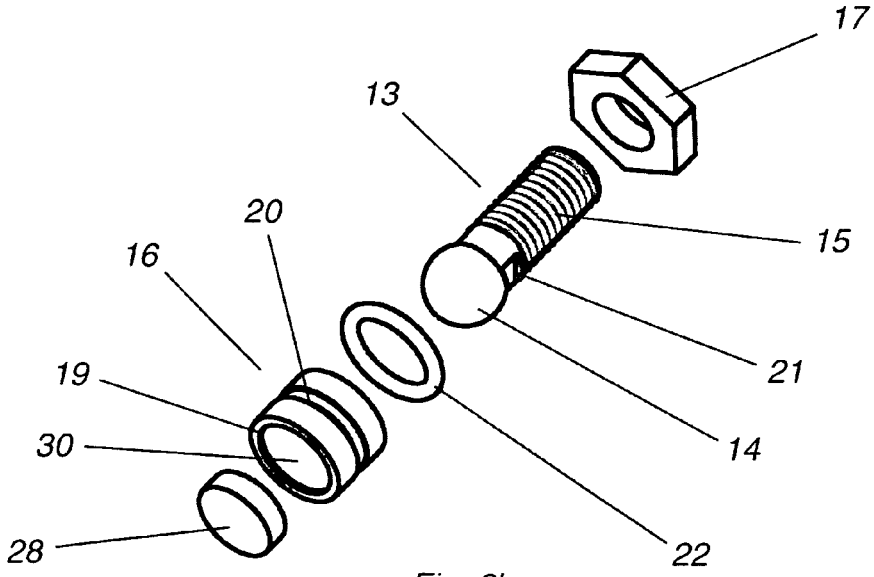
FIG. 6*b* is a second view of a pivot and pivot cup assembly.

The truck assembly 12 includes a tubular stem 35 having a pivot pin recess 23 to hold a pivot pin 13 with a rounded pivot 14 at one end. FIGS. 6*a* and 6*b* show the pivot pin 13 and related components in detail, including a cup recess 26 formed in the base plate 50, with a cup recess bottom 29 and cup recess sides 27. Preferably there is a vent hole in the cup recess bottom 29 to prevent air or debris from being trapped. The pivot pin 13 also has a threaded end 15 which is threaded into the pivot pin recess 23 in order to enable precise axial adjustment via a pair of wrench flats 21 or equivalent gripping surfaces. A nut 17 is used to lock the adjusted pivot pin 13 in place.

The rounded pivot 14 engages a pivot cup 16, which in the present invention is preferably made of phosphor bronze alloy for durability and low friction. The pivot cup 16 has a radiused cup socket 18 inside, configured to rotationally engage the rounded pivot 14, and includes a radial groove 20 sized to hold an O-ring 22 and has an inner lip chamfer 24 allowing greater angular movement by the pivot pin 13. The O-ring 22 provides friction against the cup recess sides 27 to retain the pivot cup 16 in place in the cup recess 26 formed in the base plate 50, allowing the pivot cup 16 to float in the cup recess 26 of the plate 50 during skate use. The pivot cup 16 sits on a small axially oriented axial cushion 28 which when pressed against the cup recess bottom 29 serves to establish the typical "bottom" position of the pivot cup 16 and which acts as a shock absorber during use, particularly during impact. Preferably the axial cushion 28 is made of an elastomeric material such as a urethane. The additional controlled flexure and impact damping provided by a friction retained floating pivot cup 16 sitting on an axial cushion 28 provides superior impact absorption over the skate designs of the prior art. The O-ring 22 being a radially oriented resilient element also absorbs lateral loads experienced during skating and permits a necessary degree of lateral movement, further isolating the base plate 50 and thus the skater from vibration and impact. Wear on the pivot cup 16 is greatly reduced, permitting smoother pivoting action (and thus better steering control) and a longer lifespan for the pivot pin 13 and the pivot cup 16. The combination of the pivot pin 13, the floating pivot cup 16, the axial cushion 28 functioning as an axially oriented resilient element and the O-ring 22 functioning as a radially oriented resilient element serve to provide a third steering and suspension action.

Preferably there is a recess 30 in the cup end 19 bottom surface of the pivot cup 16, whereby the use of a narrower diameter elastomeric axial cushion 28 axially positioned by the recess 30 permits radial expansion of the axial cushion 28 during downward movement of the pivot cup 16 under load and thus permits a greater range of cushion movement and improved tuning of shock absorption. Axial adjustment of the pivot pin 13 provides the ability to preload the triple action mechanism for best performance under a range of use conditions. With such a preloaded triple action steering and suspension mechanism, when the inner cushion 42 (as opposed to the outer cushion 44) compresses, the pivot cup 16 and rounded pivot 14 are now kept mechanically engaged, thus giving superior steering control. In prior art roller skate steering and suspension mechanisms, a high force applied to the inner cushion 42 would tend to cause the rounded pivot 14 to pull up and out of the pivot cup 16.

By using the axial cushion 28 and floating pivot cup 16 in combination with the inner cushion 42 and outer cushion 44 positioned by the king pin 40, the distance between the axles 36 remains more constant. Additionally, there is no impact-generated "slap" of the suspension running into a hard limit during jumps and other impact-generating skating maneuvers. Further, there is less lateral (shearing) stress on the kingpins 40. Additionally, the floating pivot cup mechanism will also provide improved performance with standard prior art skate trucks. The triple action mechanism allows the skate trucks to more accurately maintain a set orientation during use, because the pivot mechanism can now follow the truck motion up and down in concert with changes in the loading on the bushings. Because there is no metal on metal or metal on hard plastic contact and all joints are cushioned, the steering and suspension mechanism provides improved shock and vibration isolation and thus smoother skating and less fatigue and injury to the skater.

In the first version of the present invention, the pivot pin 14 held in the tubular stem 35 of the truck 32 is preferably positioned at approximately 45 degrees from the plane of the base plate 50, and likewise the kingpin 40 is also preferably positioned at approximately 45 degrees from the plane of the base plate 50. The kingpins 40 are threaded into a kingpin recess 41 in the plate 50. The preferred included angle between the pivot pin 14 and the kingpin 40 in a given truck assembly 12 is thus approximately 90 degrees, giving a more even distribution of forces between the parts of the skate wheel suspension. The floating pivot cup 16 also aids in evening out the distribution of forces. This mechanical configuration also permits more uniform movement of the axles 36 up and down rather than backward and forward during high loads and impacts, thus serving to keep a more constant distance between the axles 36, and thereby providing more control to the skater. This dual 45 degree angular configuration, and the extension of the axle 36 out beyond the kingpin 40, serve to lessen the required angle needed for a given degree of steering, and thus the skater doesn't need to lean as far to steer.

Figure 4:
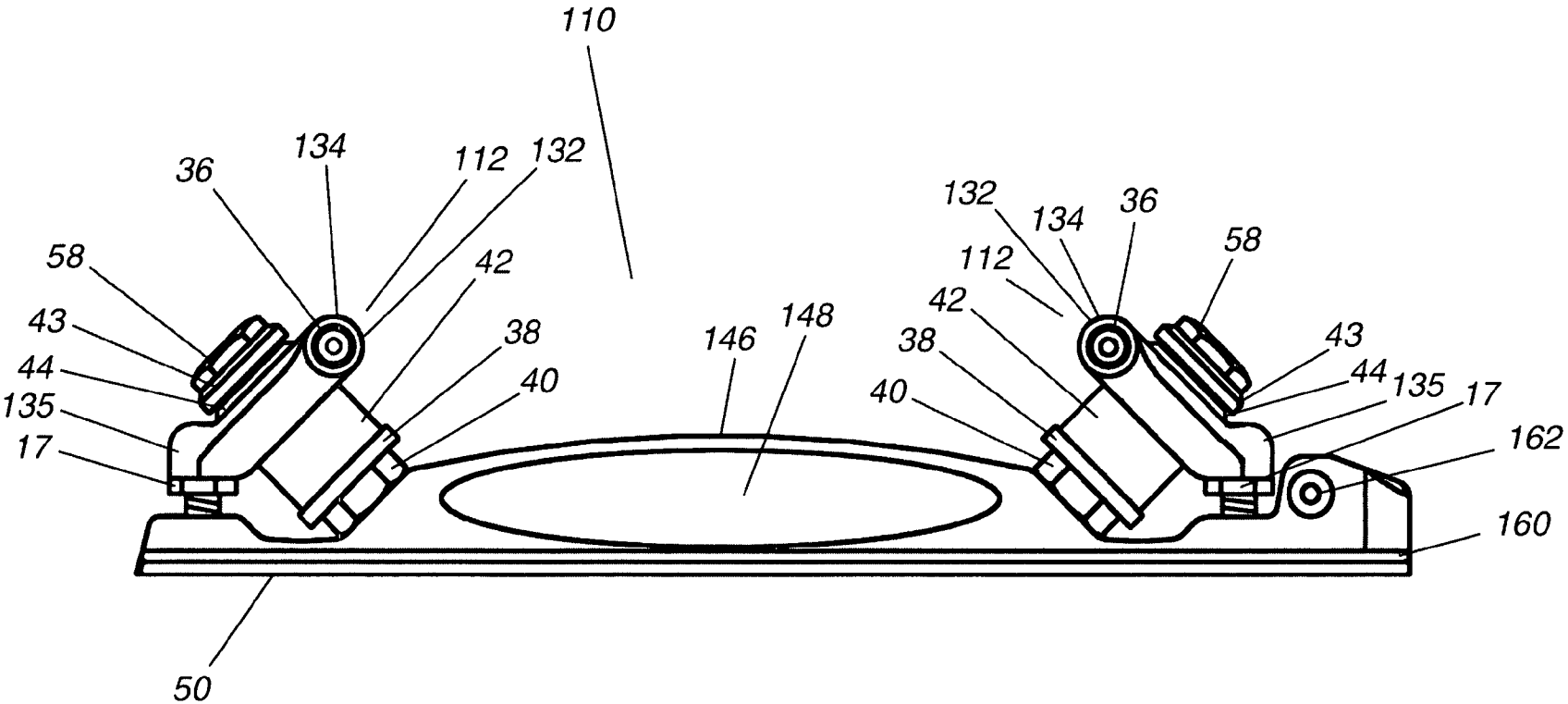
FIG. 4 is an elevation view of a second roller skate steering and suspension mechanism.
Figure 7C:
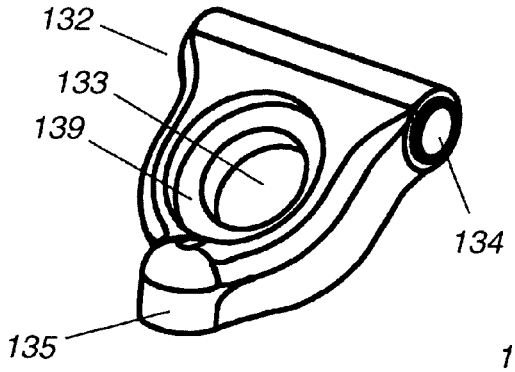
FIG. 7*c* is a first perspective view of a second truck.
Figure 7D:
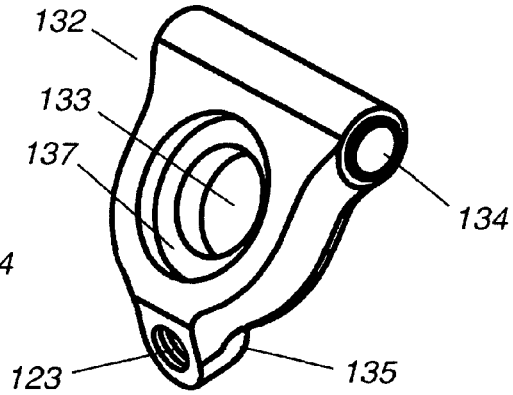
FIG. 7*d* is a second perspective view of a second truck.

A second version of the present invention is shown in FIG. 4, wherein a second roller skate steering and suspension mechanism 110 features a second truck assembly 112 based on a second truck 132. The second base plate 150 has a similar arched stiffener bar 146 and oval side opening 148, as well as fillets 160 and bumper clamping features 162. FIGS. 7*c* and 7*d* show the second truck 132 in greater detail, where the tubular axle holder 134, the kingpin aperture 133, the inner cushion recess 137 and the outer cushion recess 139 are similar to those of the first truck 32. The significant differences in the second truck 132 are the tubular axle holder 134 being in the main plane of the second truck 132, and the tubular stem 135 being angled approximately 45 degrees to the main plane of the second truck 132. The pivot pin recess 123 is thus approximately perpendicular to the base plate 150 and the axles 36 are closer together, giving a shorter wheelbase and more responsive steering, though with an incremental decrease in lateral stability. Optionally, a pivot retainer (not shown) may be fastened over the rounded pivot 14 to prevent possible separation from the cup socket 18 during some high-force skating maneuvers.

Figure 5:
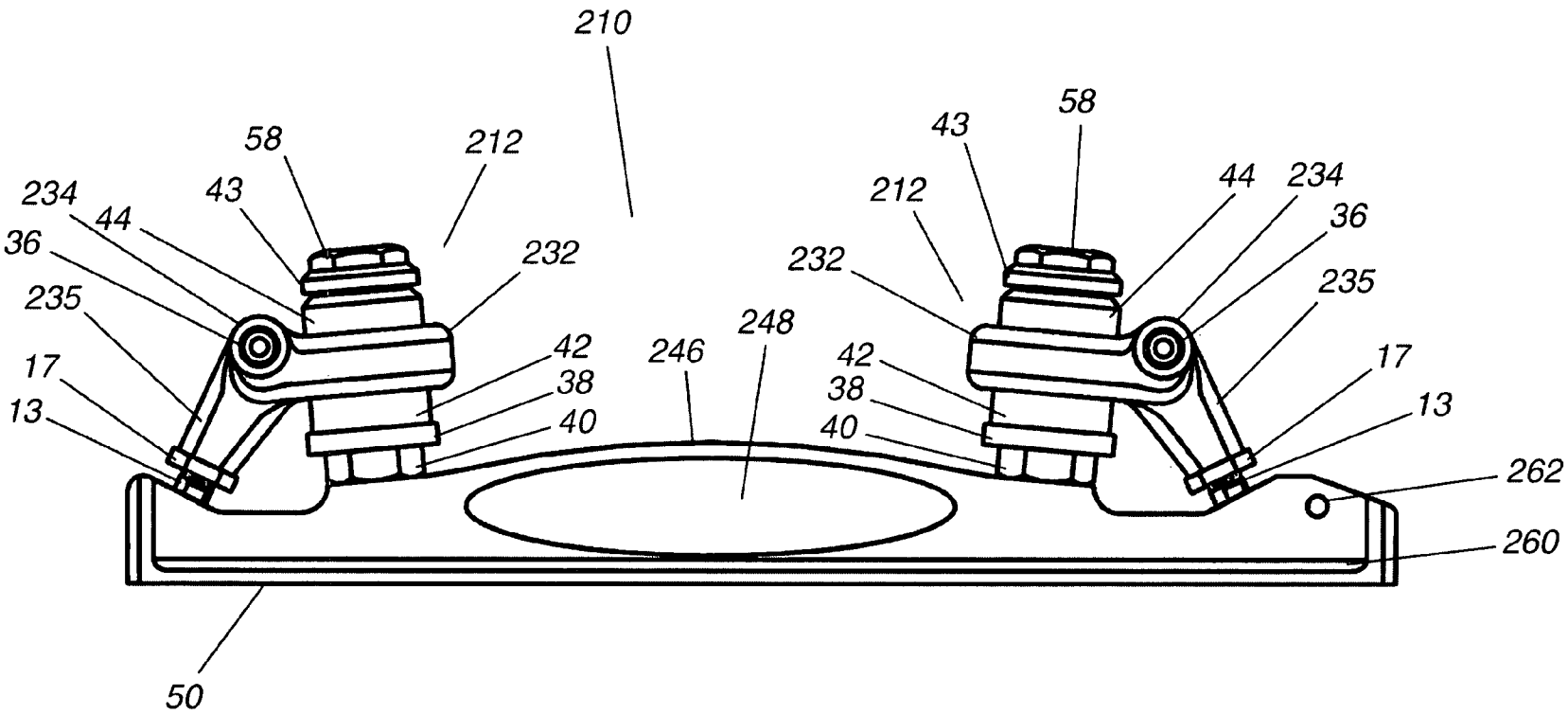
FIG. 5 is an elevation view of a third roller skate steering and suspension mechanism.
Figure 7E:
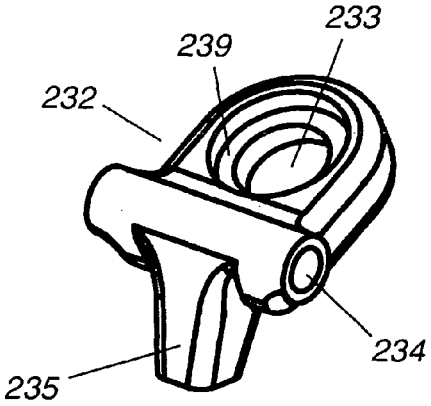
FIG. 7*e* is a first perspective view of a third truck.
Figure 7F:
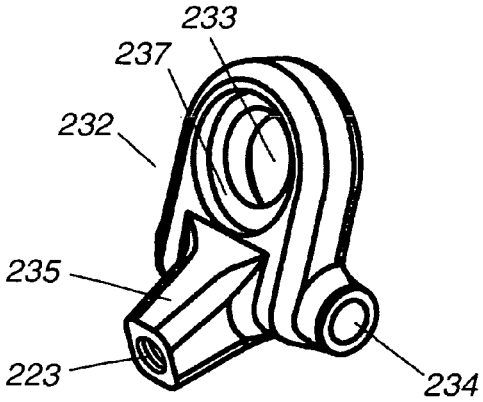
FIG. 7*f* is a second perspective view of a third truck.

A third version of the present invention is shown in FIG. 5, wherein a third roller skate steering and suspension mechanism 210 features a third truck assembly 212 based on a third truck 232. The third base plate 250 has a similar arched stiffener bar 246 and oval side opening 248, as well as fillets 260 and bumper clamping features 262. FIGS. 7*e* and 7*f* show the third truck 232 in greater detail, where the tubular axle holder 234, the kingpin aperture 233, the inner cushion recess 237 and the outer cushion recess 239 are similar to those of the first truck 32 and the second truck 132. The third pivot pin recess 223 is also threaded similarly to the other pivot pin recesses. The significant differences in the third truck 232 are the positioning of the tubular axle holder 234 between the kingpin aperture 233 and the tubular stem 235, the included angle between the kingpin 40 and the pivot pin 13, and the approximately 85 degree angle of the kingpin 40. The geometry for the third roller skate steering and suspension mechanism 210 greatly enhances lateral stability, requiring more lean by the skater for a given amount of steering, as compared to the first roller skate steering and suspension mechanism 10 or the second roller skate steering and suspension mechanism 110.

Figure 8:
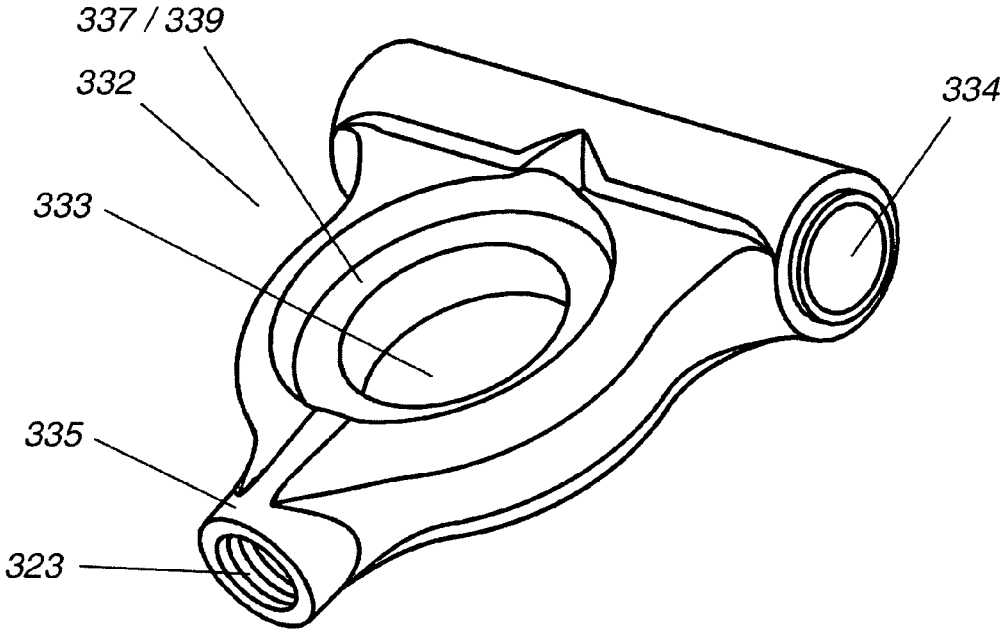
FIG. 8 is a perspective view of a fourth truck.

A fourth truck 332 as shown in FIG. 8 is similar to the first truck 32 except that the fourth truck 332 is symmetrical about a center plane with respect to the tubular axle holder 334, the kingpin aperture 333, the pivot pin recess 323 and the tubular stem 335. The kingpin aperture 333 is disposed between the tubular axle holder 334 and the tubular stem 335. The inner cushion recess 337 and the outer cushion recess 339 are offset from and generally oppositely disposed with respect to the center plane, although they may differ with respect to depth, angle, exact diameter and contour. The tubular axle holder 334 is in line with this center plane and both perpendicular to and bisected by the pivot pin axis. The kingpin aperture 333, the pivot pin recess 323 and the tubular stem 335 are substantially similar to that of the first truck 32. For some skating applications, the fourth truck 332 may be used in a front truck assembly in combination with a rear-mounted first truck assembly 12 or in fact any other different truck assembly, in order to produce a hybrid performance roller skate with a slightly shorter wheelbase and a slight forward angular tilt.

The axles 36 and ball studs 14 are preferably made of hardened and tempered chromoly type alloy steel. Alternatively the axles 36 may be preferably made of heat treated titanium alloy of a high strength type such as Grade 5. The trucks 32, 132, 232, 332 and plate 50 are preferably made of high strength aluminum alloy such as 7075T6. Other skate steering and suspension mechanism hardware is preferably made of 7000 series high strength aluminum alloys.

An alternate embodiment of the roller skate steering and suspension mechanism has the top face of the inner cushion 42 being a spherical section, mating with a matched radius formed into the inner cushion recess 37 in the truck 32. These mated spherical surfaces permit even more responsive steering, as well as more even cushion wear and less chance of the cushions splitting during use. This more even cushion wear reduces the need to rotate or replace cushions, thus reducing the needed amount of skate maintenance.

Another alternate embodiment of the roller skate steering and suspension mechanism, particularly applicable to the third roller skate steering and suspension mechanism 210, has the inner cushion 42 optimized for larger skaters by increasing the bushing base diameter and tapering upwards to fit existing trucks, while also using a softer material. The combination of the wider inner cushion 42 base diameter and softer (lower durometer) cushion material provide smoother response during leaning and improved turnability even for larger skaters. In particular, when steering, the use of larger base diameter and softer outer cushions allows all four wheels to stay in contact with the floor while the skate wheels are toeing in for turning, thus providing better stability and more uniform wheel wear. With heavier skaters, this can also reduce the occurrence of axle bending. The use of larger diameter inner cushions also allows a softer bushing without wheel bite (wheels contacting the bottom of the skate shoe or boot) resulting from excessive truck deflection. Differential steering is a prior art term for the use of different hardnesses or durometers of inner and outer cushions to improve steering and stability. The use of a wider inner cushion base diameter and softer (lower durometer) cushion material in combination simultaneously provides improved steering and stability for larger skaters.

Having described herein illustrative embodiments and best mode of the present invention, persons of ordinary skill in the art will appreciate various other features and advantages of the invention apart from those specifically described above. It should therefore be understood that the foregoing is only illustrative of the principles of the invention, and that various modifications and additions can be made by those skilled in the art without departing from the spirit and scope of the invention. Accordingly, the appended claims shall not be limited by the particular features that have been shown and described, but shall be construed also to cover any obvious modifications and equivalents thereof.

What is claimed is:

1. A roller skate steering and suspension mechanism, comprising:

a base plate having at least one pivot cup mounting hole and at least one kingpin mounting hole;

said pivot cup mounting hole having interior sides and a bottom;

a pivot cup having a cup body, a cup socket and a cup end disposed opposite said cup socket;

said pivot cup positioned to float without direct contact in said pivot cup mounting hole such that said cup socket faces outwards;

a radially disposed resilient means for shock absorbing in mechanical communication between a portion of said cup body and a portion of said interior sides, said radially disposed resilient means for shock absorbing providing the functions of retaining said pivot cup within said pivot cup mounting hole, absorbing lateral loads experienced by said pivot cup, and providing lateral movement for said pivot cup in response to lateral loads;

an axially disposed resilient means for shock absorbing in mechanical communication between a portion of said cup end and a portion of said bottom;

a skate truck having at least one wheel axle holder, a pivot pin socket, and a kingpin aperture;

a pivot pin having a pivot pin axis, a proximal end comprising a threaded section and a distal end comprising a rounded pivot;

said threaded section being threaded into said pivot pin socket, said rounded pivot in rotary mechanical communication with said cup socket;

a kingpin having a kingpin axis, said kingpin being attached into said kingpin mounting hole;

said pivot pin axis and said kingpin axis being intersecting;

an upper resilient cushion disposed above said truck and a lower resilient cushion disposed below said truck;

said kingpin being disposed through said kingpin aperture; and, said upper resilient cushion and said lower resilient cushion being clamped against said skate truck along said kingpin axis, thereby holding said skate truck in a resiliently fixed orientation.

2. The roller skate steering and suspension mechanism of claim 1, wherein said rounded pivot comprises at least in part a ball shape having a pivot ball diameter greater than the diameter of said pivot pin.

3. The roller skate steering and suspension mechanism of claim 1, wherein said pivot pin is axially adjustable to regulate force of contact between said rounded pivot and said pivot cup, thereby providing mechanical preloading for said mechanism against both static and dynamic loads.

4. The roller skate steering and suspension mechanism of claim 1, wherein the shape of said cup recess includes a spherical section dimensioned to mechanically mate with said rounded pivot, thereby providing improved surface contact and rotation angle for said rounded pivot.

5. The roller skate steering and suspension mechanism of claim 1, wherein said pivot cup has a chamfered lip to provide greater angular travel by said pivot pin.

6. The roller skate steering and suspension mechanism of claim 1, wherein said pivot cup includes at least one external radial groove for retaining said radially disposed resilient means.

7. The roller skate steering and suspension mechanism of claim 6, wherein said radially disposed resilient means comprises at least one O-ring.

8. The roller skate steering and suspension mechanism of claim 1, wherein said axially disposed resilient means comprises an elastomeric cushion.

9. The roller skate steering and suspension mechanism of claim 1, wherein said cup end includes a bottom recess for retaining said axially disposed resilient means.

10. The roller skate steering and suspension mechanism of claim 1, wherein said axially disposed resilient means is smaller in diameter than said pivot cup, thereby permitting radial expansion of said axially disposed resilient means during axial compression, and thereby permitting a greater distance of axial travel.

11. The roller skate steering and suspension mechanism of claim 1, wherein said kingpin aperture is disposed on said skate truck between said pivot pin socket and said axle holder.

12. The roller skate steering and suspension mechanism of claim 11, wherein said skate truck is symmetrical about a center plane;

said axle holder has a center axis through said center plane; and, said axle holder center axis is bisected by and perpendicular to said pivot pin axis.

13. The roller skate steering and suspension mechanism of claim 11, wherein said axle holder is offset from said pivot axis.

14. The roller skate steering and suspension mechanism of claim 1, wherein said axle holder is disposed on said skate truck between said pivot pin socket and said kingpin aperture.

15. The roller skate steering and suspension mechanism of claim 1, further comprising an angle of approximately 45 degrees between said pivot pin axis and said kingpin axis, and an angle of approximately 45 degrees between said kingpin axis and said base plate.

16. The roller skate steering and suspension mechanism of claim 1, further comprising an angle of approximately 45 degrees between said pivot pin axis and said base plate, and an angle of approximately 45 degrees between said kingpin axis and said base plate.

17. The roller skate steering and suspension mechanism of claim 1, wherein said base plate provides mounting for two of said skate trucks wherein one functions as a forward skate truck and one as a rear skate truck.

18. The roller skate steering and suspension mechanism of claim 17, wherein said forward skate truck has a center plane;

said axle holder of said forward skate truck, said pivot pin socket of said forward skate truck, and said kingpin aperture of said forward skate truck being symmetrical about and bisected by said center plane;

said axle holder of said forward skate truck having a center axis through said center plane;

said axle holder center axis being bisected by and perpendicular to said pivot pin axis; and, said forward skate truck and said rear skate truck being of different geometry with respect to the location of features selected from the group consisting of axle holder, pivot pin socket and kingpin aperture, whereby said roller skate steering and suspension mechanism incorporates a greater range of mechanical properties than from two identical skate trucks.

19. The roller skate steering and suspension mechanism of claim 17, wherein the periphery of said base plate is contoured generally like a shoe sole for improved support of a skate shoe.

20. The roller skate steering and suspension mechanism of claim 19, wherein said base plate is made of a single piece of material and includes a transversely open reinforcing arch to provide lightweight lengthwise stiffening.

21. The roller skate steering and suspension mechanism of claim 20, wherein said transverse opening through said arch is an oval, and a portion of the area underneath said arch is open through said base plate, whereby further lightening of said base plate is provided with a minimum of decrease in structural strength.

22. The roller skate steering and suspension mechanism of claim 21, wherein said base plate further comprises a front pivot cup mounting hole and kingpin mounting hole region, an arch region, and a rear pivot cup mounting hole and kingpin mounting hole region;

said base plate being configured in a plurality of lengths to fit a plurality of skate shoe sizes;

said pivot cup mounting hole and kingpin mounting hole regions being of consistent dimensions irrespective of the overall length of said base plate; and, said arch having a length varying proportional to the overall length of said base plate.

23. The roller skate steering and suspension mechanism of claim 1, wherein said skate truck has a cushion recess for positioning said inner cushion;

said cushion recess having a radiused bottom surface; and, a face of said inner cushion being a spherical section contoured to substantially match and rotationally mate with said radiused bottom surface.

24. The roller skate steering and suspension mechanism of claim 1, wherein said inner cushion has a first face and a second face;

said first face having a wider diameter than said second face;

said first face being oriented towards said base plate and said second face being oriented towards said truck; and, said inner cushion having a lower durometer than said outer cushion.

25. The roller skate steering and suspension mechanism of claim 1, further comprising a front skate truck assembly and a rear skate truck assembly;

said front skate truck assembly having a front skate truck and said rear truck assembly having a rear skate truck;

said kingpin aperture being disposed on both said front skate truck and said rear skate truck between said pivot pin socket and said axle holder;

said front skate truck is symmetrical about a center plane;

said axle holder of said front skate truck has a center axis through said center plane;

said axle holder center axis is bisected by said pivot pin axis of said front skate truck; and, said axle holder of said rear skate truck being offset from said pivot axis of said rear skate truck.

26. A triple action roller skate steering and suspension system comprising:

a base plate having at least one pivot cup mounting hole and at least one kingpin mounting hole;

a kingpin having a kingpin axis, said kingpin being attached into said kingpin mounting hole;

a skate truck having at least one wheel axle holder, a pivot pin socket, and a kingpin aperture with said kingpin disposed therethrough;

a first resilient cushion radially surrounding a portion of said kingpin and in mechanical communication with said skate truck;

a first cushion support radially surrounding a portion of said kingpin and disposed in fixed relation to said base plate between said base plate and said first resilient cushion and in mechanical communication with said first resilient cushion;

said first resilient cushion thereby providing a first steering and suspension action;

a second resilient cushion radially surrounding a portion of said kingpin and in mechanical communication with said skate truck;

said second resilient cushion being disposed opposite said first resilient cushion in relation to said skate truck;

a second cushion support radially surrounding a portion of said kingpin and disposed in fixed relation to said base plate, wherein said second cushion support is in mechanical communication with said second resilient cushion and disposed opposite said second resilient cushion in relation to said skate truck;

said skate truck thereby being resiliently supported between said first and second resilient cushions and said second resilient cushion thereby providing a second steering and suspension action;

said pivot cup mounting hole having interior sides and a bottom;

a pivot cup having a cup body, a cup socket and a cup end disposed opposite said cup socket;

said pivot cup positioned to float without direct contact in said pivot cup mounting hole such that said cup socket faces outwards;

a radially disposed resilient means for shock absorbing in mechanical communication between a portion of said cup body and a portion of said interior sides, said radially disposed resilient means for shock absorbing providing the functions of retaining said pivot cup within said pivot cup mounting hole, absorbing lateral loads experienced by said pivot cup, and providing lateral movement for said pivot cup in response to lateral loads;

an axially disposed resilient means for shock absorbing in mechanical communication between a portion of said cup end and a portion of said bottom;

a pivot pin having a pivot pin axis, a proximal end comprising a threaded section and a distal end comprising a rounded pivot;

said threaded section being threaded into said pivot pin socket, said rounded pivot in rotary mechanical communication with said cup socket; and, whereby the combination of said pivot pin, said pivot cup, said radially disposed resilient means for shock absorbing and said axially disposed resilient means for shock absorbing provides a third steering and suspension action.

27. The triple action roller skate steering and suspension mechanism of claim 26, wherein said rounded pivot comprises at least in part a ball shape having a pivot ball diameter greater than the diameter of said pivot pin.

28. The triple action roller skate steering and suspension mechanism of claim 26, wherein said pivot pin is axially adjustable to regulate force of contact between said rounded pivot and said pivot cup, thereby providing mechanical preloading for said mechanism against both static and dynamic loads.

29. The triple action roller skate steering and suspension mechanism of claim 26, wherein the shape of said cup recess includes a spherical section dimensioned to mechanically mate with said rounded pivot, thereby providing improved surface contact and rotation angle for said pivot.

30. The triple action roller skate steering and suspension mechanism of claim 26, wherein said pivot cup includes at least one external radial groove for retaining said radially disposed resilient means.

31. The triple action roller skate steering and suspension mechanism of claim 30, wherein said radially disposed resilient means comprises at least one O-ring.

32. The triple action roller skate steering and suspension mechanism of claim 26, wherein said axially disposed resilient means comprises an elastomeric cushion.

33. The triple action roller skate steering and suspension mechanism of claim 26, wherein said cup end includes a bottom recess for retaining said axially disposed resilient means.

34. The triple action roller skate steering and suspension mechanism of claim 26, wherein said axially disposed resilient means is smaller in diameter than said pivot cup, thereby permitting radial expansion of said axially disposed resilient means during axial compression, and thereby permitting a greater distance of axial travel.

35. A steering and suspension action for a skate mechanism comprising:

a base plate having at least one pivot cup mounting hole;

said pivot cup mounting hole having interior sides and a bottom;

a pivot cup having a cup body, a cup socket and a cup end disposed opposite said cup socket;

said pivot cup positioned to float without direct contact in said pivot cup mounting hole such that said cup socket faces outwards;

a radially disposed resilient means for shock absorbing in mechanical communication between a portion of said cup body and a portion of said interior sides, said radially disposed resilient means for shock absorbing providing the functions of retaining said pivot cup within said pivot cup mounting hole, absorbing lateral loads experienced by said pivot cup, and providing lateral movement for said pivot cup in response to lateral loads;

an axially disposed resilient means for shock absorbing in mechanical communication between a portion of said cup end and a portion of said bottom;

a skate truck having a pivot pin socket;

a pivot pin having a pivot pin axis, a proximal end comprising a threaded section and a distal end comprising a rounded pivot;

said threaded section being threaded into said pivot pin socket, and, said rounded pivot in rotary mechanical communication with said cup socket, whereby said pivot pin can be threadedly mechanically preloaded against said pivot cup, and transmission of mechanical forces from said base plate or from said truck cause said pivot cup to travel up and down in said pivot cup mounting hole and to be resiliently supported against mechanical impacts by said axially disposed resilient means and said radially disposed resilient means.

36. A skate truck comprising:

a body having a center plane;

said body having an axle holder, a pivot pin socket, and a kingpin aperture;

said axle holder, said pivot pin socket, and said kingpin aperture being symmetrical about said center plane;

said kingpin aperture being disposed between said pivot pin socket and said axle holder;

an inner cushion recess in said body, radially disposed around said kingpin aperture;

an outer cushion recess in said body, radially disposed around said kingpin aperture;

said inner cushion recess and said outer cushion recess being offset from and generally oppositely disposed with respect to the center plane, although they may differ with respect to geometric attributes from the group consisting of depth, angle, exact diameter and contour;

said axle holder having a center axis approximately coplanar with said center plane; and, said axle holder center axis being bisected by and perpendicular to said pivot pin axis.

* * * * *